US008650821B2

(12) United States Patent
Ely, Jr.

(10) Patent No.: US 8,650,821 B2
(45) Date of Patent: Feb. 18, 2014

(54) MULTI-USE TALL BUILDING STRUCTURE

(76) Inventor: Donald A. Ely, Jr., Park Ridge, IL (US)

( * ) Notice: Subject to any disclaimer, the term of this patent is extended or adjusted under 35 U.S.C. 154(b) by 692 days.

(21) Appl. No.: 12/451,439

(22) PCT Filed: May 13, 2008

(86) PCT No.: PCT/US2008/006055

§ 371 (c)(1),
(2), (4) Date: Sep. 13, 2010

(87) PCT Pub. No.: WO2009/032025

PCT Pub. Date: Mar. 12, 2009

(65) Prior Publication Data

US 2010/0325987 A1 Dec. 30, 2010

Related U.S. Application Data

(60) Provisional application No. 60/917,666, filed on May 13, 2007.

(51) Int. Cl.
*E04H 1/00* (2006.01)
*E04B 1/19* (2006.01)

(52) U.S. Cl.
CPC ... *E04B 1/19* (2013.01); *E04H 1/00* (2013.01)
USPC ..... 52/236.3; 52/236.6; 52/236.7; 52/651.01; 52/651.04; 52/651.09; 52/651.07; 52/652.1; 244/114 R

(58) Field of Classification Search
USPC ..... 52/40, 234, 236.7, 236.9, 240, 649.3, 52/651.01, 651.04, 651.05, 651.07, 65.09, 52/651.11, 652.1, 745.17–745.2, 651.09, 52/236.3; 244/114 R
See application file for complete search history.

(56) References Cited

U.S. PATENT DOCUMENTS

| | | | | | |
|---|---|---|---|---|---|
| 2,481,343 | A * | 9/1949 | Redstone | 244/114 R |
| 4,656,799 | A * | 4/1987 | Maryon | 52/236.3 |
| 4,974,795 | A * | 12/1990 | Christol | 244/114 R |
| 5,377,465 | A * | 1/1995 | Kobori et al. | 52/236.3 |
| 6,082,058 | A * | 7/2000 | Deng | 52/745.2 |
| 7,392,624 | B2 * | 7/2008 | Kinzer | 52/651.07 |
| 7,694,486 | B2 * | 4/2010 | Murphy et al. | 52/651.04 |

FOREIGN PATENT DOCUMENTS

| | | | |
|---|---|---|---|
| EP | 0550780 | * | 7/1993 |
| GB | 2365886 | * | 7/2000 |

* cited by examiner

*Primary Examiner* — Mark Wendell
*Assistant Examiner* — Matthew J Smith
(74) *Attorney, Agent, or Firm* — Donald A. Ely, Jr.

(57) ABSTRACT

A multi-story tall building structure consisting plurality of three or more towers which are the primary structure enclosing a space longitudinally and transversely therein which are multiple floor/ceiling assemblies for multiple use occupied spaces including condos, military areas, observation, hotels, restaurants, retail, and offices. Each of the three towers has three or more vertical structural elements such as solid or hollow columns, or steel, concrete, or masonry constructs vertically extending. As an alternative occupied space including an aircraft landing deck or platform is attached to the top of the structure.

18 Claims, 15 Drawing Sheets

Elyport Tower (Partial)
Prospective View Showing
Tower Components:
Small Triangle Decks,
Large Triangle Decks,
& Columns.

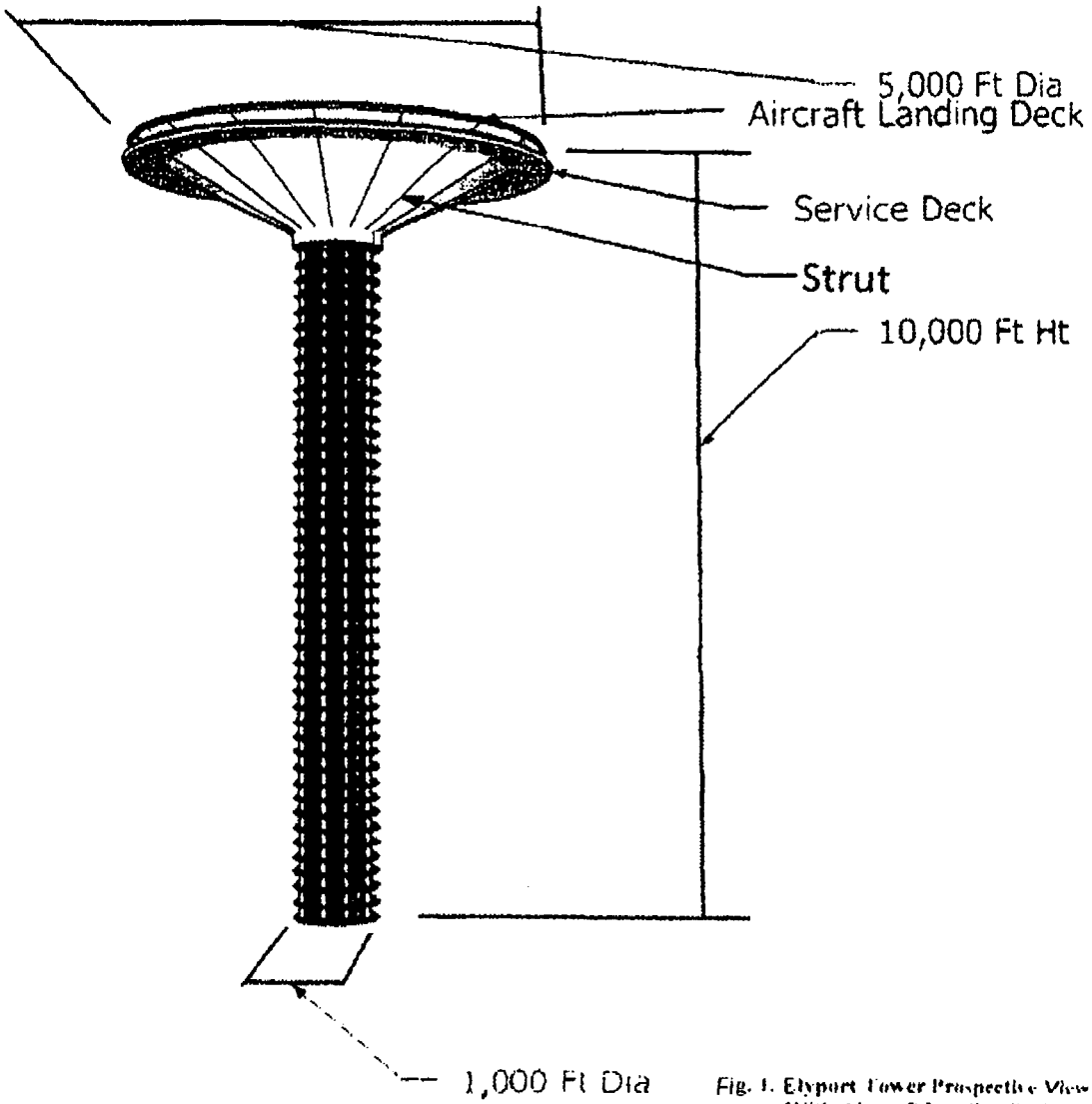
Fig. 1. Elyport Tower Prospective View With Aircraft Landing Deck, Aircraft Service Deck, and Occupied Spaces. See Levels & Uses Schedules.

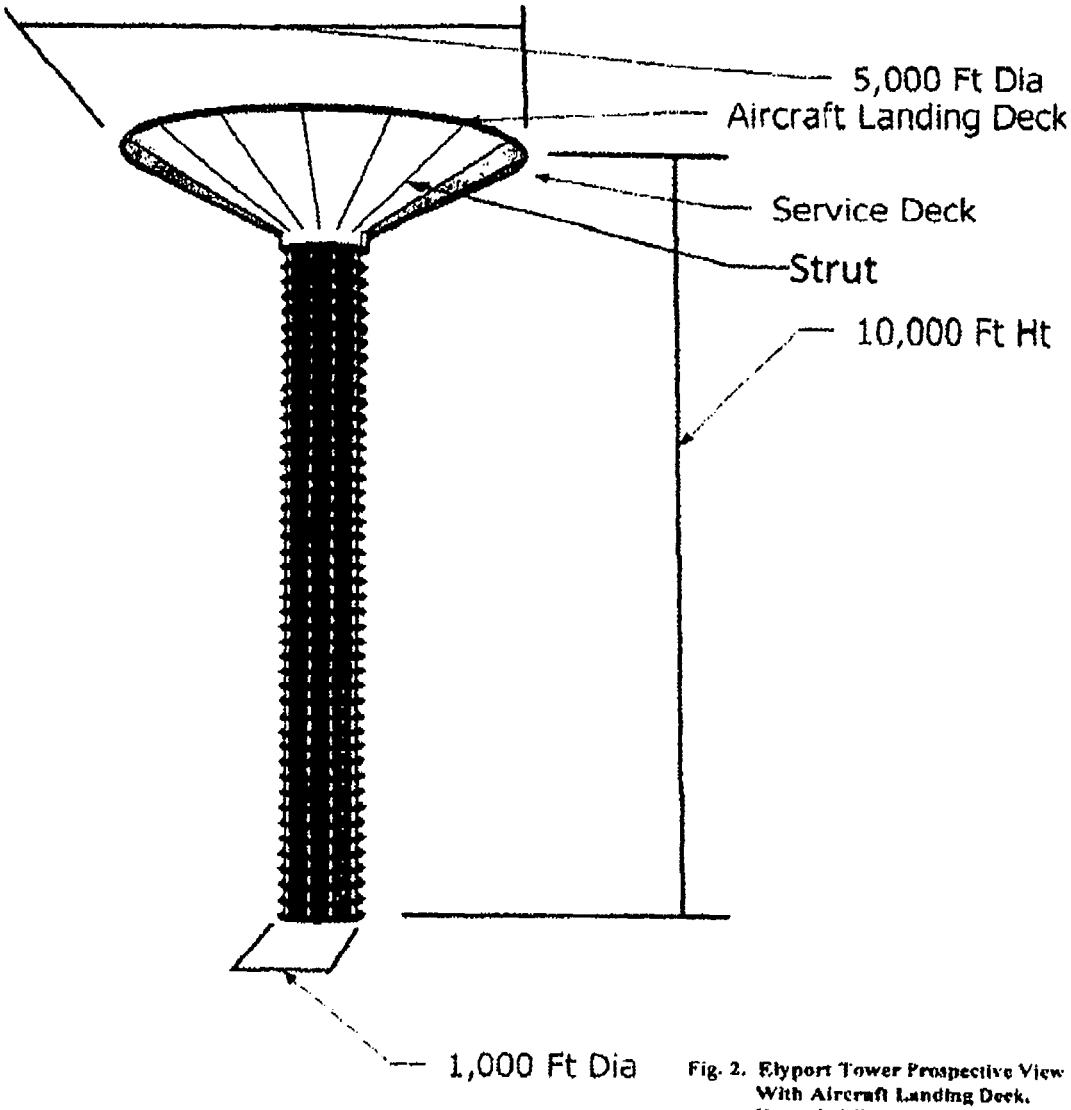
Fig. 2. Elyport Tower Prospective View With Aircraft Landing Deck, Occupied Spaces, and Without Aircraft Service Deck. See Levels & Uses Schedules.

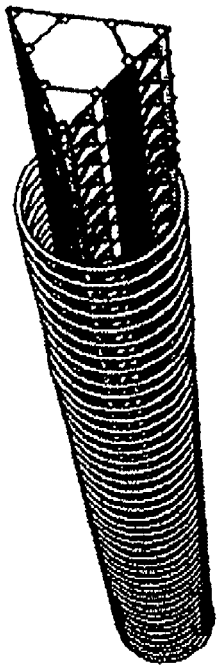
Fig 3. Flyport Tower Aerial View Without Aircraft Landing Deck, Aircraft Service Deck, and Upper Cone.

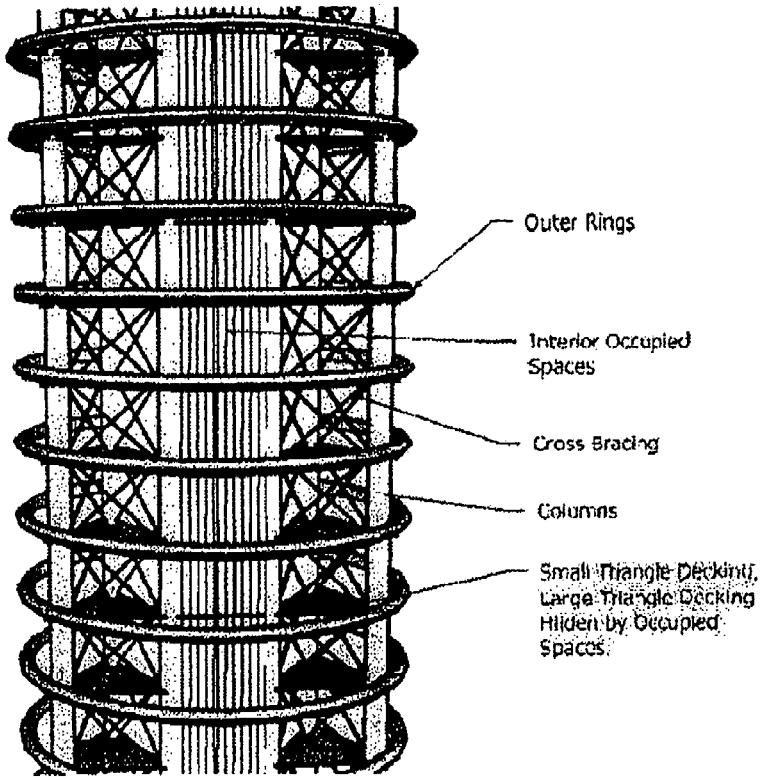
Fig. 4. Elyport Tower (Partial) Prospective View Showing All Tower Components: Outer Rings, Interior Occupied Spaces, Cross Bracing, Small Triangle Decks, Large Triangle Decks, & Columns.

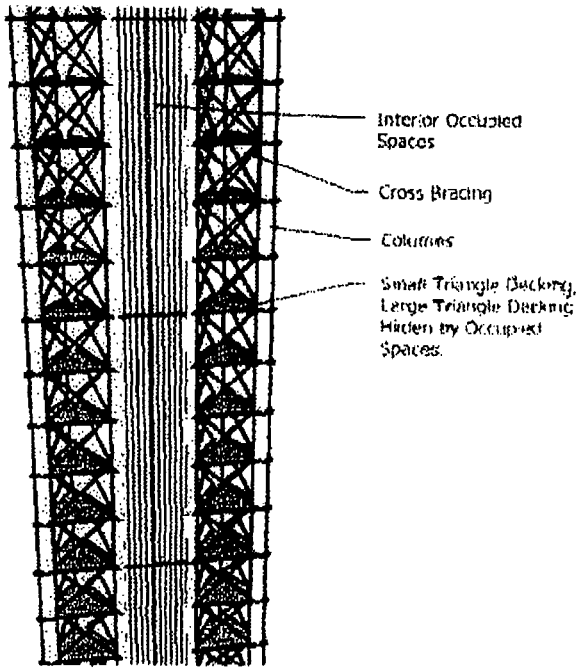
Fig. 5. Elyport Tower (Partial) Prospective View Showing Tower Components: Interior Occupied Spaces, Cross Bracing, Small Triangle Decks, Large Triangle Decks, & Columns.

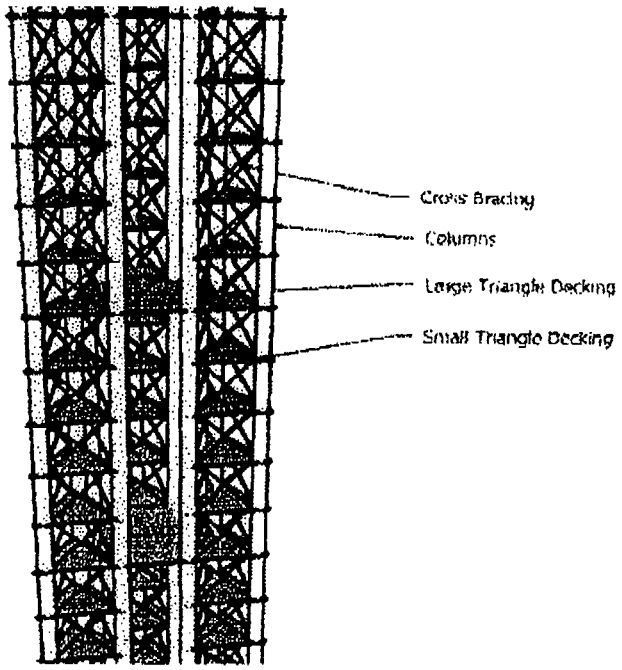
Fig. 6. Elyport Tower (Partial) Prospective View Showing Tower Components: Cross Bracing, Small Triangle Decks, Large Triangle Decks, & Columns.

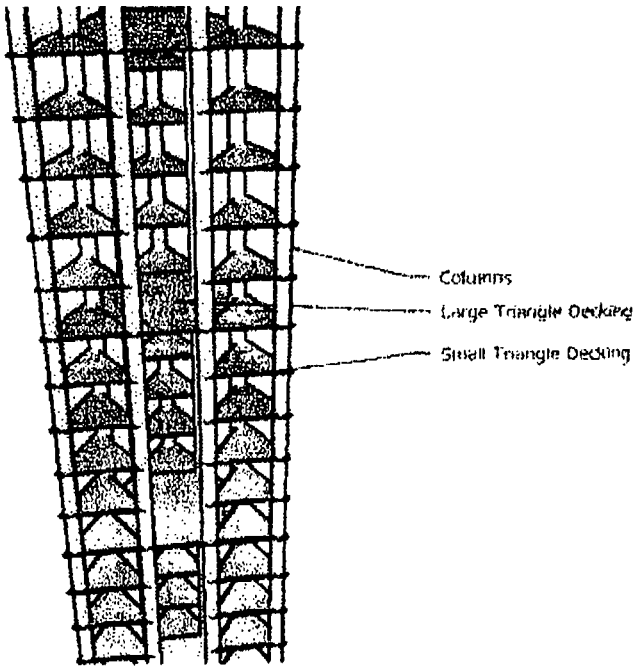
Fig. 7. Elyport Tower (Partial) Prospective View Showing Tower Components: Small Triangle Decks, Large Triangle Decks, & Columns.

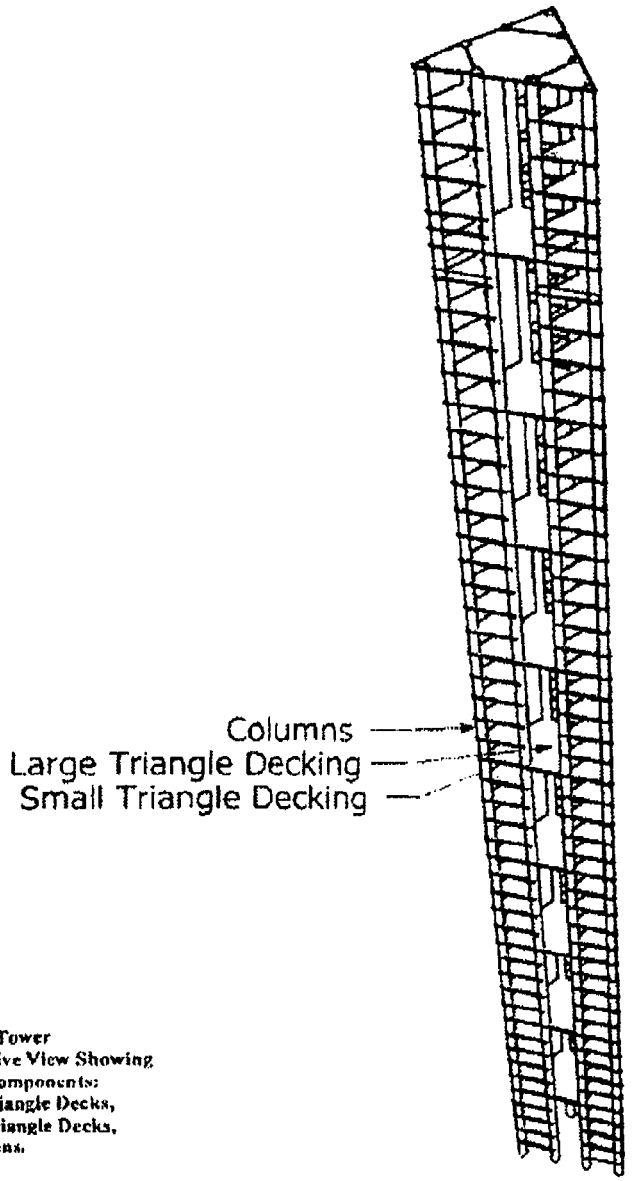
Fig. 8. Elyport Tower
Prospective View Showing
Tower Components:
Small Triangle Decks,
Large Triangle Decks,
& Columns.

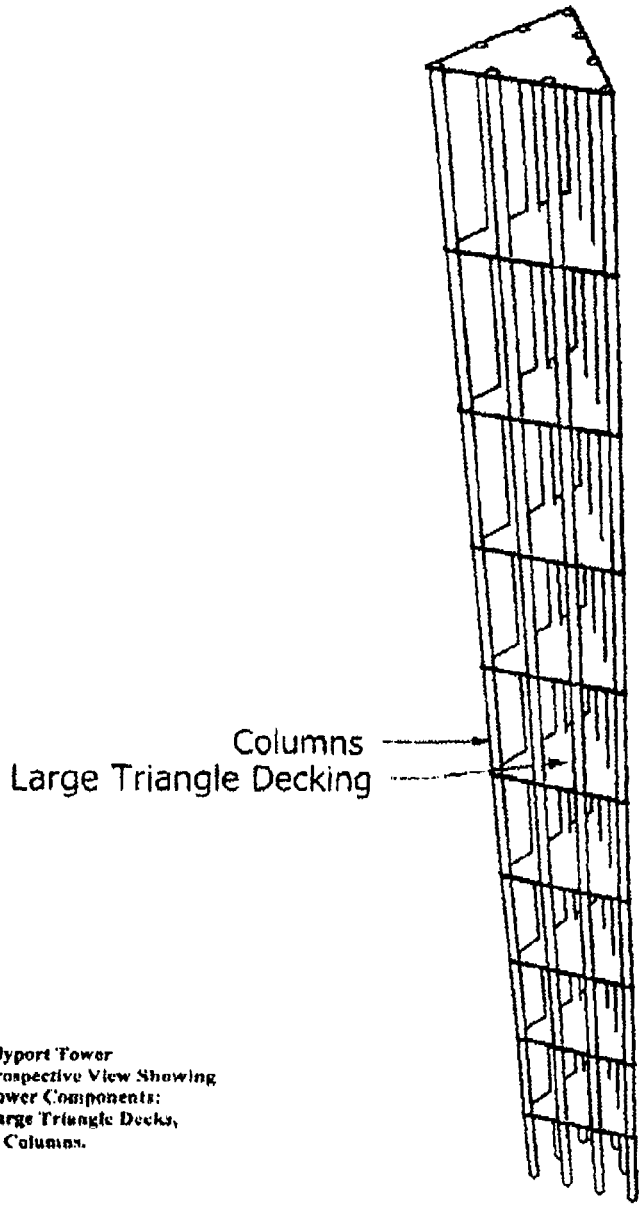
Fig. 9. Elyport Tower
Prospective View Showing
Tower Components:
Large Triangle Decks,
& Columns.

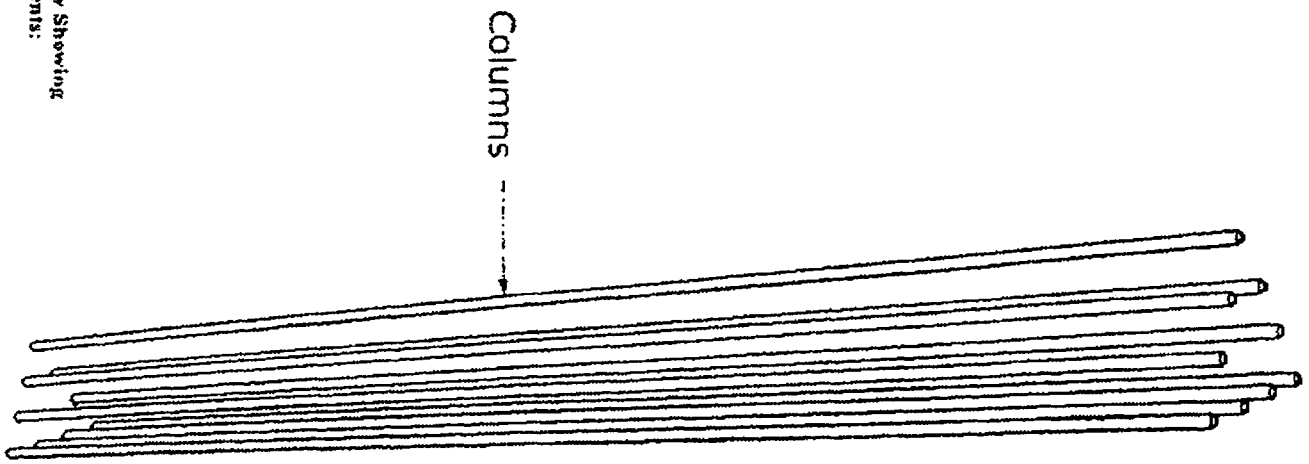
Fig. 10. Elyport Tower
Prospective View Showing
Tower Components:
Columns.

PLAN @ LANDING PLATFORM

PLAN @ GRADE

MULTI-USE TALL BUILDING STRUCTURE

CROSS-REFERENCE TO RELATED APPLICATION

This application claims priority of U.S. Provisional Application Ser. No. 60/917,666, filed 13 May 2007.

BACKGROUND OF THE INVENTION

Current tall building structures are based upon steel or concrete columns and beams framework. The columns and beams become the integral parts of the floor and wall assemblies of the occupied spaces. The tallest buildings in the world based upon this type of structure are Taipei 101, Taipei, Taiwan at 1,671 ft, Petronas Twin Towers, Kuala, Malaysia at 1,483 ft, and Sears Tower, Chicago, Ill., USA at 1,451 ft. One prominent problem with this type of design is that it is complicated in design and construction. It is difficult and expensive to build these tall buildings, and height of buildings is limited. Further, buildings constructed using conventional methods are susceptible to terror attacks.

Known construction arrangements for such buildings are reflected in the patent literature. The following patents provide some examples: U.S. Pat. No. 3,710,527 to Farebrother, issued 16 Jan. 1973, is directed to a multi-storey building of which the walls and floors are erected from prefabricated panels, each wall panel extends from one to the other of two adjacent floors and the opposite ends of each floor panel are supported respectively, upon the upper edges of panels in two adjacent parallel walls, a plurality of continuous, vertical ducts, each extending the full height of the building, is formed in each of the walls and the floor panels supported thereby, a co-extensive reinforcing member in each duct is bonded to the surface of the duct by a solidified fill surrounding the member and forced, before solidification, into the lower end of the duct, and the floor panel ends supported by each internal wall are castellated, the tongues of the castellations are shorter than the thickness or are located wholly between the faces of the respective wall panels and are narrower than the pockets in the castellated ends, and each of the tongues is engaged in and is located symmetrically to a corresponding one of the pockets in the adjacent castellated end of another of the floor panels and is bonded to the pocket by a solidified fill inserted, before solidification, into clearances between the sides and tip of the tongue and the sides and floor of the pocket.

In another example, U.S. Pat. No. 4,245,447 to Depondt et al., issued 20 Jan. 1981, shows a multi-use metal building comprises a skeleton composed of vertical posts connected to upper and lower horizontal longitudinal girders, thus forming a frame ensuring transverse and longitudinal stability. In the horizontal plane, the skeleton comprises self-supporting metal trough elements modulated to the same width as the posts, with corrugated cross section, these trough elements resting on the upper longitudinal girders of the frame and serving on the one hand as floor support and on the other hand as roof. The vertical walls (posts, upper and lower longitudinal girders, outer skin made of asbestos and inner insulating partition) ensure the vertical stability in both directions.

In yet another example, U.S. Pat. No. 5,678,375 to Juola issued 21 Oct. 1997, a building framework comprises a plurality of steel girders, steel columns, and steel connecting members for joining at least one girder with at least one column to form the building framework. Further provided is a plurality of substantially flat coupling elements, each having opening therein, wherein at least one column and at least one connecting member each terminate with at least one coupling element. The coupling elements substantially match each other and extend outward beyond the outer wall of the column and of the connecting member for providing attachment therebetween. The girders, columns and coupling elements are reinforced with concrete extending through the coupling elements via the openings.

Finally, U.S. Pat. No. 6,802,160 to Harambasic issued 12 Oct. 2004, describes a building structure formed from modular building elements, which include first modular building elements having socket beam interconnection means, second modular building elements and socket beams having first modular building element interconnection means; whereby a socket beam forms an interconnection with at least one first modular building element and at least one second modular building element associates with a socket beam and first modular building element interconnection, a socket beam and at least one first modular building element and at least one second modular building element forming a configuration unit, the configuration unit being repeatable one atop the other, and being repeatable in a side-by-side fashion, a first modular building element associating or abutting with adjacent first modular building elements, a second modular building elements associating or abutting with adjacent second modular building elements and a socket beam associating or abutting with adjacent socket beams.

There are taller structures than the buildings noted above in the form of towers such as KVLY-TV mast, Blanchard, N. Dak., USA at 2,063 ft, and the CN Tower, Toronto, Canada at 1,815 ft. These structures support antennas and sometimes small occupied spaces. These structures are quite often quick and easy to construct because structural elements are characteristically simpler, similar, and modular. The main problem with these types of structures is that they do not allow large occupied spaces. One example of a patent describing a conventional tower is U.S. Pat. No. 3,994,108 to Johnson issued 30 Nov. 1976, is directed to a tower structure wherein said structure comprises a series of rings stacked in end to end relationship with sealing means between adjacent rings to form a tubular section, anchor means are provided exterior and interior of said section and stabilizing means connect said section at spaced locations along its length to said anchor means.

Large commercial airports and their attendant fixed runways are frequently located at large land spaces adjacent to large metropolitan areas. There are many problems with the use of these runways because of the noise, congestion, pollution, airport expansion, and safety. Runways and airports provide little to assist the airplanes in shorting the distances for take off and landings. Because of this failure of assistance there are many safety hazards.

One object of the present invention is to simplify design and construction of tall buildings. Another object of the invention is build tall buildings in a less expensive manner. Another object of the invention is to be able to build taller buildings. Another object of the invention is to make buildings terror proof. Another object of the invention is to us tower type structure to support large occupied spaces. Another object of the invention is to use a tall building to support an elevated airport with runways. Another object of the invention is to be able to change the orientation of runways easily based upon wind direction and/or air traffic conditions. Another object of the invention is to have components of the airport and runways that will allow take off and landings on shorter runways. Airplanes and elevators especially designed with their own unique features will be covered in separate applications.

SUMMARY OF THE INVENTION

A multi-story tall building structure consisting plurality of three or more towers which are the primary structure enclosing a space longitudinally and transversely therein which are multiple floor/ceiling assemblies for multiple use occupied spaces including condos, military areas, observation, hotels, restaurants, retail, and offices. Each of the three towers has three or more vertical structural elements such as solid or hollow columns, or steel, concrete, or masonry constructs vertically extending. As an alternative occupied space including an aircraft landing deck or platform is attached to the top of the structure.

BRIEF DESCRIPTION OF THE DRAWINGS

Embodiments of the invention are illustrated by way of example, and not by way of limitation, in the figures of the accompanying drawings and in which like reference numerals refer to similar elements and in which:

FIG. 1 illustrates a perspective view of an embodiment of a tower having an aircraft landing deck, an aircraft service deck, and occupied spaces, in accordance with the principles of the present invention.

FIG. 2 illustrates a perspective view of an embodiment of a tower having an aircraft landing deck and occupied spaces, but without an aircraft service deck, in accordance with the principles of the present invention.

FIG. 3 illustrates an aerial perspective view of a tower without deck structure.

FIG. 4 illustrates a detailed perspective view of a portion of a tower section showing outer rings, interior occupied spaces, cross bracing, small triangle decks, large triangle decks, and columns.

FIG. 5 illustrates a detailed sectional view of a portion of a tower section showing interior occupied spaces, cross bracing, small triangle decks, large triangle decks, and columns.

FIG. 6 illustrates a detailed sectional view of a portion of a tower section showing interior cross bracing, small triangle decks, large triangle decks, and columns.

FIG. 7 illustrates a detailed sectional view of a portion of a tower section showing small triangle decks, large triangle decks, and columns.

FIG. 8 illustrates a detailed sectional view of a portion of a tower section showing interior cross bracing, small triangle decks, large triangle decks, and columns.

FIG. 9 illustrates a detailed sectional view of a portion of a tower section showing large triangle decks, and columns.

FIG. 10 illustrates a detailed sectional view of a portion of a tower section showing columns.

DETAILED DESCRIPTION OF THE INVENTION

Figure 11A:
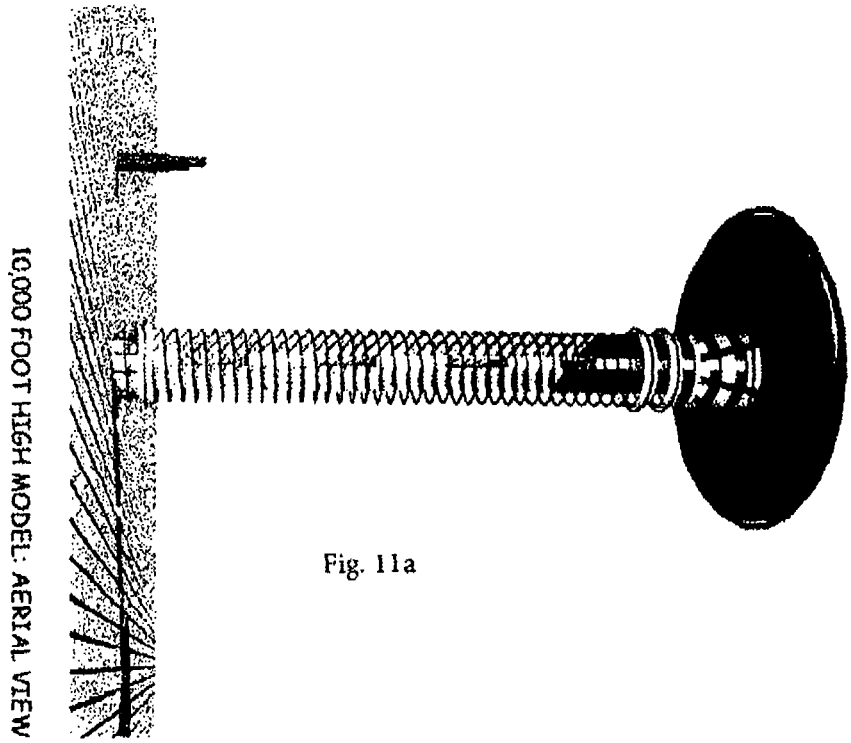
FIGS. 11*a*, 11*b* illustrate a perspective view of an embodiment of towers having exterior spiral coils in place of outside rings, and struts instead of a solid cone supporting the aircraft landing deck, and an upper globe suspended as an observation station.

In the following description, specific details are set forth in order to provide a thorough understanding of the invention. However, it will be apparent that the invention may be practiced without these specific details. Without departing from the generality of the invention disclosed herein and without limiting the scope of the invention, the discussion that follows, will refer to the invention as depicted in the drawings.

The first embodiment of the present invention is shown in FIG. 1. The subsequent Figures show the Elyport structure as components are removed to reveal detail of the structure. The starting point of the structure is the last Fig with columns shown in FIG. 10. There are three tower structures. Each tower structure has at least three columns each. This with the connections can be seen in FIG. 8. Each of the towers three columns are arranged about a central axis. As may be seen, the three columns of each tower form a polygon, here shown as an equilateral triangle. In this equilateral triangle, the central axis of each tower is the intersection of medians joining each of the three vertexes with middle point of the opposite side. The triangle form which is subsequently called the small triangle deck. The three towers are arranged and oriented to form a larger equilateral triangle as shown. The small triangles are arranged equidistant about a central axis, which is the intersection of the furthermost vertex of each small triangle with the middle point of the opposite side of the large triangle.

The basic structure and frame of my invention is a geometric construct which is the formula for the building. This type of repetitive, symmetric framework that has constant relationship of components is easy, fast and economical to build. But it also is appealing to look at since the basic shapes and components are quite often found in nature-round versus square, three legs instead of two or four, the minimum for holding anything up, tall cylindrical shape with a globe shape on top, similar to a tree, and roots or a caisson foundation deep into the ground. Devices to convert sunlight, wind force, and thermal differentials to electric power and other useful forms of energy can easily be mounted on the structure to facilitate a "green type building", which is friendly to the environment. Areas can also be provided also for bird nesting, not shown.

In the first embodiment, the three columns in each tower are connected by small triangular deck sections as shown in FIG. 8. Each of the towers is connected to the other towers by large triangular deck sections shown in FIG. 9. The columns can be uniform in size and be prefabricated to affect a modular type building for ease of construction. The lower column components may be thicker or filled to support the weight above, and the higher components maybe made of lighter weight or composite materials to lessen the weight load on the lower component columns. Column components can have male and female ends so as to facilitate quick assembly as one column modular component is added on top of another.

Similarly the large and small triangular deck sections can be prefabricated. Various materials can be used-steel, concrete, combination of steel and concrete, or composite materials. All components can be connected by various mechanical means such as welding, bolting, riveting, and friction fit although gluing and magnetic fastening will work in some variations. The decks are uniform in size and thickness and therefore lend themselves to modular component type construction techniques.

Next cross bracing is added as shown in FIG. 6. The cross bracing can take the form of cables connected to eye bolts welded to the columns. Although any shear wall type construction will be suitable. Next the major interior occupied space is added between the three towers as shown in FIG. 5.

The occupied space will have floor and wall structures connected to the three towers for support. Connections can be by mechanical means as with the large and small triangular decks.

Next as shown in the first embodiment outer rings are added as shown in FIG. 4. These rings shown are hollow and serve two purposes. First they provide a decorative finish, and second they provide and obstacles for any terrorist attack. The rings are connected to each other with vertical rods not shown, and each series of rings is connected to the triangular decks by mechanical means.

The entire structure including all components-columns, decks, and cross bracing is such size and can include redundancy so that any failure of a particular component or attack will not cause the structure to fail. The columns shown in the first embodiment are 50 feet in diameter and round. There is redundancy in other parts of the structure so that the building would not fail if struck by a large commercial airliner. FIG. 3 clearly shows an aerial view of the three tower structures with interior occupied space and the outer rings. FIG. 2 shows the first embodiment of the Elyport in a variation without the aircraft service deck. The aircraft service deck and the aircraft landing deck are shown in FIG. 1. This variation shows a solid cone for support of these decks.

Figure 11B:
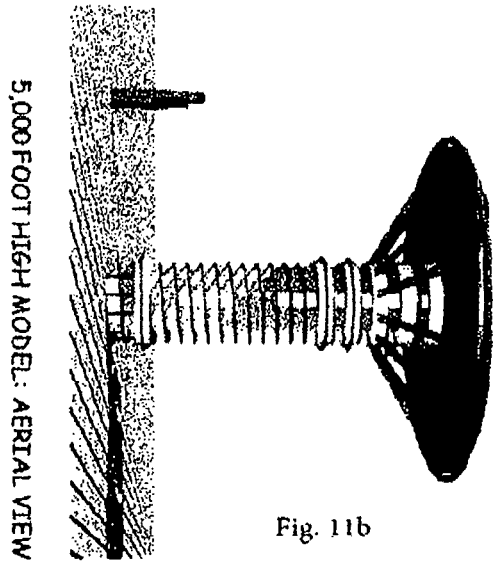
Figure 12A:
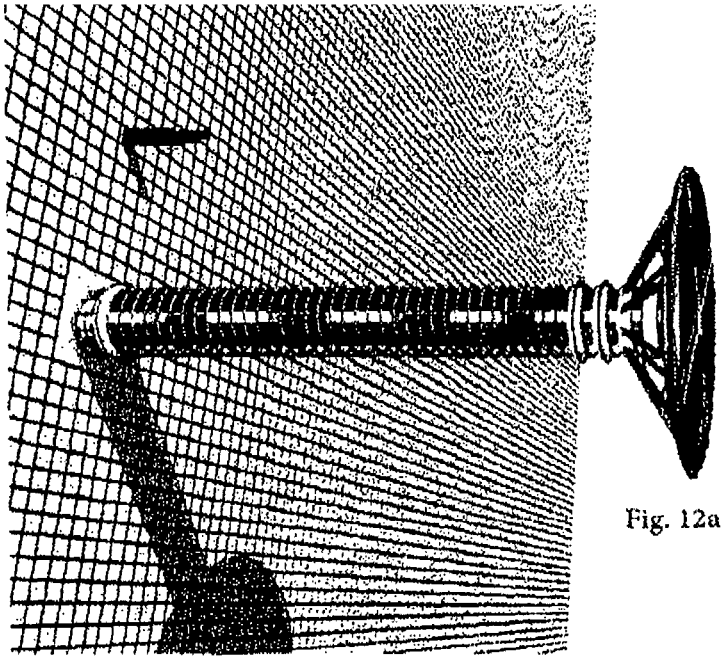
FIGS. 12*a*, 12*b* illustrate a perspective view of the FIG. 11 showing the towers from a different angle.
Figure 12B:
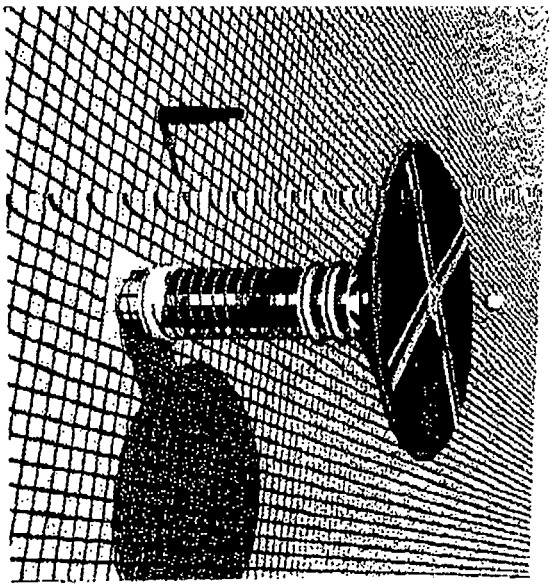
Figure 13A:
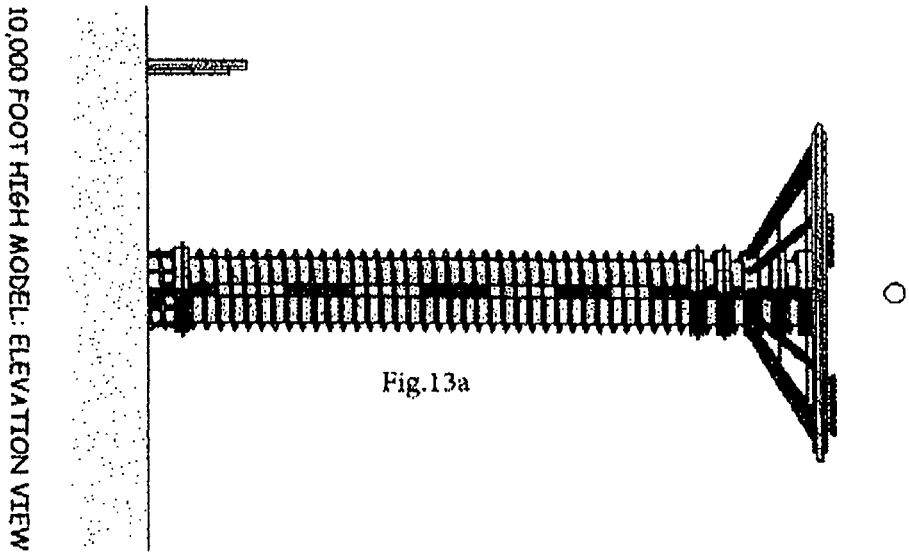
FIGS. 13*a*, 13*b* illustrate an elevational view of the FIG. 11 towers.
Figure 13B:
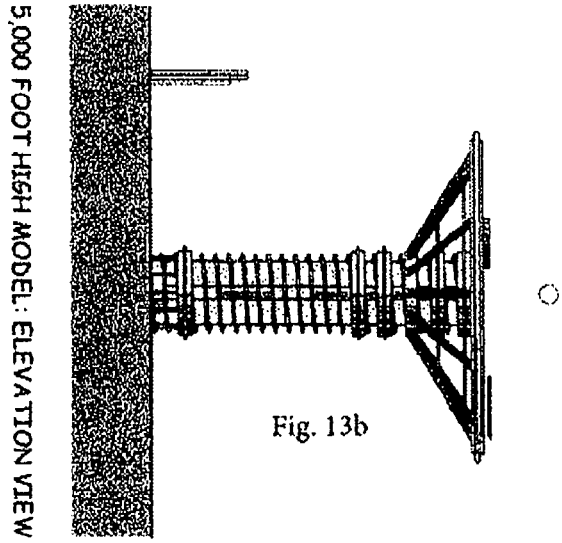

FIGS. 11 through 13 show variations with struts supporting a deck instead of a solid cone. These embodiments also illustrate the rings as being replaced by a helical coil. This gives a different appearance as there are many variations.

The aircraft landing deck shown in the first, taller embodiment is 5000 feet in diameter. Smaller or larger decks are also contemplated. The second, 5000 foot deck will accommodate small and medium size commercial jet aircraft without any special accommodation of the aircraft or the tower.

Because aircraft landing deck is elevated it can easily be made of an open type grid system which improves stopping during landing. The grid vanes can be vertically oriented or slanted. Powerful air blasts or suction can assist landings and take offs to shorten the distances of aircraft landing strips required. Suction air will go through cyclone collectors before the suction fan. Landing strip directions can be easily changed by lighting indicators or other means to accommodate change in wind directions for the best landing conditions. A head wind being favorable for both landing and take offs. The elevated deck also lends itself to automated tug puller system integrated into the deck to move the planes into and away from passenger loading areas, or at anytime it is not desirable for the airplane to travel under its own power. Planes can move from the aircraft landing deck to the service deck, where fueling and passenger loading and loading can occur by means of ramps or elevators (not shown). Other embodiments can include tapered columns and omission of aircraft landing areas and addition of other use structures to the top of the structure.

The tower building can be constructed by placing new components on top of already installed components using tower cranes. Tower cranes are self erecting and can be placed on the large and small triangular deck sections. Several tower cranes can be used to make multiple lifts and assist erection of other tower cranes as progress of the building proceeds upward.

As an alternative to tower crane erection where components are erected by placing newly added components on top of already erected components, this tower building and other tall narrow buildings can utilize a unique construction method which is part of this invention. Basically, a modular section of each of the three tower sections, which in turn have three columns, is constructed on the ground level. These columns and large and small deck sections have jacking flanges or other means to allow use of hydraulic jacks or other lifting means to lift the three tower section simultaneously together with its connecting large and small triangle deck sections. Once the sections are lifted to sufficient height to allow the next modular section to be place under the section above, the lower and upper sections can be joined, and the process completed. The movement of materials and components to top of the building is replaced by jacking of lifting the building, and placing new components under the raised building in the space created by the jacking or lifting. Construction of the building is much easier and safer on the ground. In this manner the building is built on the ground and pushed, jacked, or lifted up into the air space above. Jacks can be hydraulic or screw driven with large gear motors. Additional jacks can be added as the weight increases. Upward movement caused by the jacks is slow and monitored by electronic computerized system to insure stability. Jacks are secured mechanically at the top and bottom to provide shear force or longitudinal stability during construction.

The foundation below the tower building can be spread footings, piles, or caissons. A unique feature of this invention is that in the first embodiment where columns of uniform diameter are used, the foundation can be caissons which are simply an extension of the columns. The caisson foundation will provide required base as the building is raised.

Figure 14A:
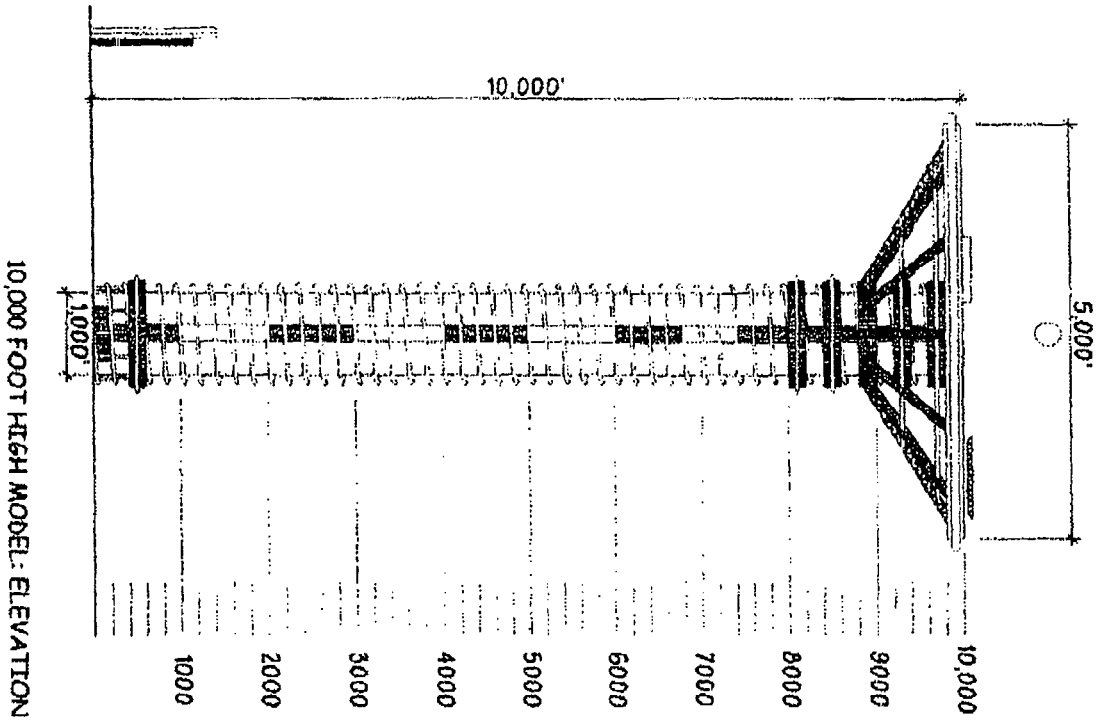
FIGS. 14*a*, 14*b* illustrate a schematic, dimensioned elevational view of the FIG. 11 towers.
Figure 14B:
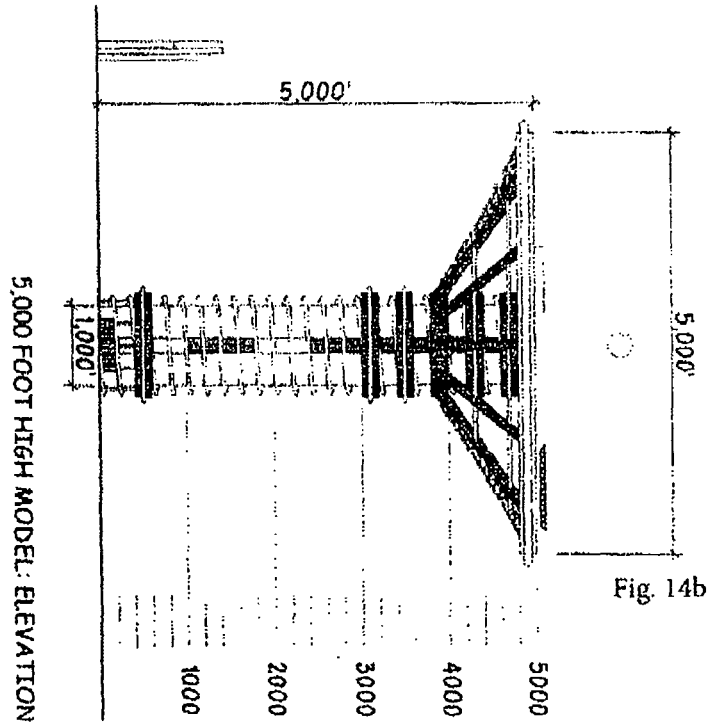
Figure 15A:
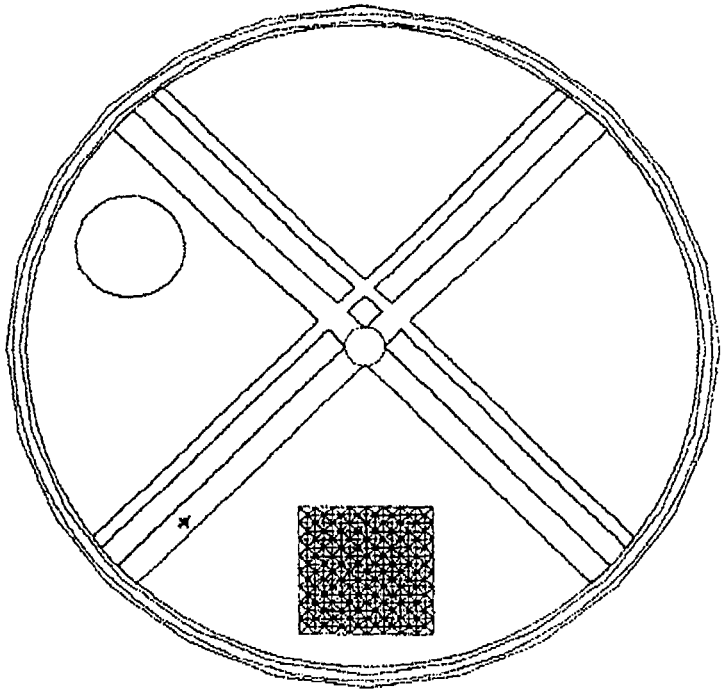
FIGS. 15*a*, 15*b* illustrate a plan view of the tower of the present invention at the landing platform and at grade.
Figure 15B:
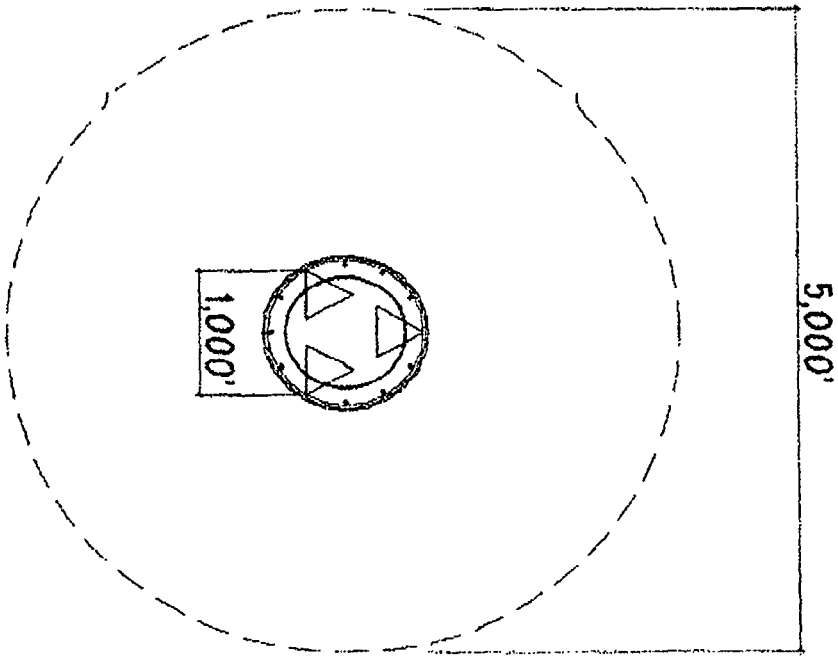

As shown in FIG. 14, the various levels can be designated for a variety of uses. For example, the 10,000 Ft level can accommodate the commercial aircraft landing area. Just below, at 9,850 Ft, the commercial aircraft service deck is located, and can be accessed by elevators and aircraft ramps. The 9,000 Ft and up levels contain terminals and service areas. Military functions can occupy the 8,000 Ft and up levels, while the 7,000 Ft and up levels are given to observation areas, restaurants, and hotels. Condominiums are located at 6,000 Ft and up, and retail can be placed at 5,000 Ft and up. In the illustrated embodiment, the levels at 4,000 Ft and up, 3,000 ft and up, 2,000 ft and up, and 1,000 ft and up are left open.

Towers constructed in accordance with the principles of the present invention present myriad advantages. For example, airports can be in or very near major metropolitan areas without danger, noise, and pollution. Valuable land now uses by airports can be converted to new uses. New types of planes that won't have to have capability of such steep ascents and descents will be designed. The less steep ascents and decent will save fuel and make airplanes simpler and easier to fly. Safety will be improved since takeoffs and landings will have the safety margin of a high structure before ground contact. Structure can accommodate large amounts of condos, restaurants, hotels, retail space, and offices, as well as military security, and elevated airplane facilities. Orientation of the runways can be shifted (with lighting indicators for changes in wind direction instead of changing runways as is done now. Terror proof construction. U.S. has opportunity to show we are not afraid.

Building of towers in accordance with the present invention will be suitable first in U.S. such as major Cities (Chicago, L.A., N.Y.) in conjunction with government agencies and real estate development firms. The public and private use will easily pay for these structures. Following U. S. installations they will be built in Europe, friendly Asian, or friendly Arab nations. A structure would be good to replace 9/11 destroyed buildings in N.Y., or as an attraction for the 2012 Olympics in Chicago or L.A.

Many of the major cities which would have a structure as shown are near large bodies of water, like Chicago. The height of the structure plus the nearness of water adds to the safety and the overall appeal of the structure.

The above building is structurally simple in design and construction utilizing a tower type frame for a very tall building. The building is easy and less expensive to build due to inherent design features with repetitive components heretofore not used on very tall buildings. The building height can be extended far above existing buildings based upon unique structural design having towers carry the load for occupied spaces. The building has structural elements which are simple, similar, and modular designed in such a manner heretofore not used on tall buildings. The building is not susceptible to terror attacks utilizing protective rings, redundancy in structural elements in an economical efficient manner for tall buildings. The building eliminates problems with existing airports and runways regarding noise, pollution, airport expansion, and safety among others by having an elevated airport that can be located in a large metropolitan area. The building provides means to shorten the distances for take off and landings utilizing air blasts and suction. The building provides redundant and oversized structural members to make the building terror proof from destructive devices including bombs, missals, and commandeered airplanes. The building made from modular components hereto before not used on tall buildings but now possible since tower structure framework is used to support occupied spaces. The building can be provided with a decorative outside finish surrounding the tower structure. The decorative finish is not part of the basic building and can be easily changed in design. The outside finish constructed to intercept bombs, missals, and commandeered aircraft. The building uses tower type structure to support large occupied spaces. The building supports elevated airport and runways. The building runways maybe easily reoriented by indicating lights or other means to change direction based upon the best orientation for takeoffs and landings based upon the wind direction at the time. The building has symmetric and repetitive structural components heretofore not used in tall building structures. The building can be a major source to generate electrical power or other useful forms of useful energy. The building has light weight materials and/or composite components. The building aircraft landing deck can have an integrated airplane tug puller system. The building or any building constructed by push up method a method heretofore not used on tall buildings.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim as my invention:

1. A building structure comprising: a first structurally independent tower structure having at least three vertical columns arranged in a polygon, the columns of the first tower structure being secured to one another by at least one decking; a second structurally independent tower structure having at least three vertical columns arranged in a polygon, the columns of the second tower structure being secured to one another by at least one decking; a third structurally independent tower structure having at least three vertical columns arranged in a polygon, the columns of the third tower structure being secured to one another by at least one decking; whereby the first, second, and third tower structures are arranged with respect to one another about a central axis to form a polygon and are secured to one another via a polygonal decking member; said polygonal decking member connecting, on one level, said first, second, and third towers, all three towers, and extending to the perimeter; whereby the vertical columns consist of steel encased ultra-high strength reinforced concrete; and whereby cross bracing is provided column to column to counteract lateral tip over forces.

2. A building structure in accordance with claim 1, wherein the polygon comprises an equilateral triangle.

3. A building structure in accordance with claim 2, wherein the towers are spanned by large triangular decks and small triangle decks.

4. A building structure in accordance with claim 1, wherein the building structure connection mechanism comprises a plurality of generally planar, horizontal decks connecting together the first, second, and third tower structures.

5. A building structure in accordance with claim 4, wherein the generally planar, horizontal decks comprise large triangle decks.

6. A building structure in accordance with claim 1, wherein the columns of each tower structure are of uniform size and configuration.

7. A building structure in accordance with claim 6, wherein each of the columns has an upper end and a lower end, and the upper end of each column is fabricated in such a way as to be lower in weight than the lower end of each column.

8. A building structure in accordance with claim 6, wherein each of the columns is prefabricated and modular.

9. A building structure in accordance with claim 1, wherein the cross bracing comprises cables connected to eye bolts welded to the columns.

10. A building structure in accordance with claim 1, further comprising occupiable space secured between the tower structures.

11. A building structure in accordance with claim 1, further comprising outer rings secured to and encircling the three tower structures.

12. A building structure in accordance with claim 1, further comprising a deck structure secured to an upper end of the three tower structures.

13. A building structure in accordance with claim 12, wherein the deck structure comprises an aircraft landing deck.

14. A building structure in accordance with claim 12, further comprising a cone securing the deck structure to the tower structures.

15. A building structure in accordance with claim 12, further comprising a plurality of struts securing the deck structure to the tower structures.

16. A building structure in accordance with claim 12, wherein the deck structure is circular and approximately 5,000 feet in diameter.

17. A building structure in accordance with claim 12, wherein the top of the structure reaches between approximately 5,000 feet and 10,000 feet in height.

18. A building structure in accordance with claim 1, wherein each of the columns is approximately 50 feet in diameter.

* * * * *